US011828552B1

(12) United States Patent
Stojaković

(10) Patent No.: US 11,828,552 B1
(45) Date of Patent: Nov. 28, 2023

(54) TRIGGER ASSEMBLY HAVING A SECONDARY DISCONNECTOR

(71) Applicant: Dragoja Stojaković, Banja Luka (BA)

(72) Inventor: Dragoja Stojaković, Banja Luka (BA)

(73) Assignee: Balkan Security Tech Group

( * ) Notice: Subject to any disclaimer, the term of this patent is extended or adjusted under 35 U.S.C. 154(b) by 0 days.

(21) Appl. No.: 18/126,896

(22) Filed: Mar. 27, 2023

Related U.S. Application Data

(60) Provisional application No. 63/449,709, filed on Mar. 3, 2023.

(51) Int. Cl.
*F41A 19/24* (2006.01)
*F41A 19/10* (2006.01)

(52) U.S. Cl.
CPC ..... *F41A 19/10* (2013.01); *F41A 19/24* (2013.01)

(58) Field of Classification Search
CPC ..... F41A 19/24; F41A 19/10
See application file for complete search history.

(56) References Cited

U.S. PATENT DOCUMENTS

| | | | | |
|---|---|---|---|---|
| 4,539,889 | A | 9/1985 | Glock | |
| 9,146,066 | B1 * | 9/2015 | Cason | F41A 19/24 |
| 10,254,067 | B2 | 4/2019 | Foster | |
| 10,267,585 | B2 | 4/2019 | Foster | |
| 10,816,297 | B1 * | 10/2020 | Williams | F41A 19/46 |
| 11,448,477 | B2 | 9/2022 | Foster | |
| 2022/0364812 | A1 * | 11/2022 | Fellows | F41A 19/24 |

OTHER PUBLICATIONS

Binary Triggers Explained, by: Firearms Legal Protection, Oct. 2021.

* cited by examiner

*Primary Examiner* — J. Woodrow Eldred
(74) *Attorney, Agent, or Firm* — Appleton Luff

(57) ABSTRACT

A trigger assembly for a firearm includes a housing with an opening adapted to receive a trigger bar guide portion of a trigger bar. The opening includes a ridge that extends downward from an upper surface of the opening. The trigger bar guide is forced downward in the opening by a connector as the trigger is pulled to cause a first disconnect of a striker resulting in a first firing. Upon release of the trigger the trigger bar guide moves upward and upon return to a released position is forced downward to cause a secondary disconnect of striker resulting in a second firing.

18 Claims, 9 Drawing Sheets

TRIGGER ASSEMBLY HAVING A SECONDARY DISCONNECTOR

RELATED APPLICATIONS

This application claims priority to U.S. provisional application 63/449,709, entitled "TRIGGER ASSEMBLY HAVING A SECONDARY DISCONNECTOR" filed on Mar. 3, 2023.

FIELD OF THE DISCLOSURE

This disclosure relates generally to firearms and more particularly to improvements to trigger systems for semiautomatic firearms.

BACKGROUND

Triggers that actuate and fire a round upon both pull and release of the trigger present various challenges to reliable operation, such as light primer strikes, unexpected trigger states during actuation and magazine changes. These challenges can be magnified when attempting to introduce such a trigger to an existing firearm frame. Accordingly, there is a need for an improved such trigger that fires a round upon both pull and release of the trigger.

SUMMARY

Disclosed herein is a trigger assembly for a firearm which in one embodiment includes a housing adapted to be mounted within a frame of the firearm. The housing has formed therein an opening having a first portion having a first vertical dimension and a second portion having a second vertical dimension. The first portion and second portion are joined by a ramp to form a lower surface of the opening. The opening also has formed thereon a tooth positioned substantially in the second portion and extends downward from the upper surface of the opening. A trigger bar is adapted to be movably attached to a trigger of the firearm and is further adapted to be movably in contact with a connector mounted to the frame. The connector upon pull of the trigger causes the trigger bar to be pushed downward. The trigger bar has formed thereon a trigger bar guide adapted to be positioned within the opening of the housing. The trigger bar guide moves upon pull of the trigger from the first portion of the opening along the ramp to the second portion of the opening to cause a first release of a striker of the firearm. The trigger bar guide is pushed upward in the second portion of the opening upon release of the trigger and upon return to the first portion of the opening the trigger bar guide is pushed downward by the tooth to cause a second release of the striker of the firearm.

The disclosed trigger assembly is particularly adapted for a striker fired, short recoil, locked breach, semi-automatic pistol with a polymer frame where the firearm employs a single linear spring-loaded striker assembly housed completely in a slide.

The disclosed trigger assembly may be provided in a kit comprising replacement parts for a trigger assembly of a handgun, where the trigger assembly includes the above-described housing, trigger bar, a trigger spring, a spring carrier and may further include one or more of, an ejector, a connector, a trigger shoe, a trigger safety, a trigger shoe pin, and a trigger safety pin.

Additional aspects related to the invention will be set forth in part in the description that follows, and in part will be apparent to those skilled in the art from the description or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive techniques.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific embodiments and implementations consistent with principles of the present invention. The components shown in the figures are not necessarily to scale and are shown in a manner to facilitate understanding to those skilled in the art of the embodiments disclosed herein. These implementations are described in sufficient detail to enable those skilled in the art to practice the invention and it is to be understood that other implementations may be utilized and that structural changes and/or substitutions of various elements may be made without departing from the scope and spirit of the present invention. The following detailed description is, therefore, not to be construed in a limited sense.

In the following description, reference may be made to various sides or portions of a firearm and in particular to a handgun. Such references are made from the perspective of an individual holding a handgun in a firing position where the bullet will travel away from the individual and the individual pulls the trigger of the handgun towards them. In such a position, the left-side of the handgun is on the individual's left, the right-side of the handgun is on the individuals' right, a lower direction is pointing downward with reference to the individual, an upper direction is pointing upward with reference to the individual, the front of the handgun is where the bullet exits the barrel and the rear of the handgun is opposite of the front, in other words the portion of the handgun closest to the individual. Similarly, a forward movement is a movement toward the front of the handgun and away from the individual and a rearward movement is opposite of a forward movement, in other words toward the rear of the handgun and toward the individual.

Figure 1:
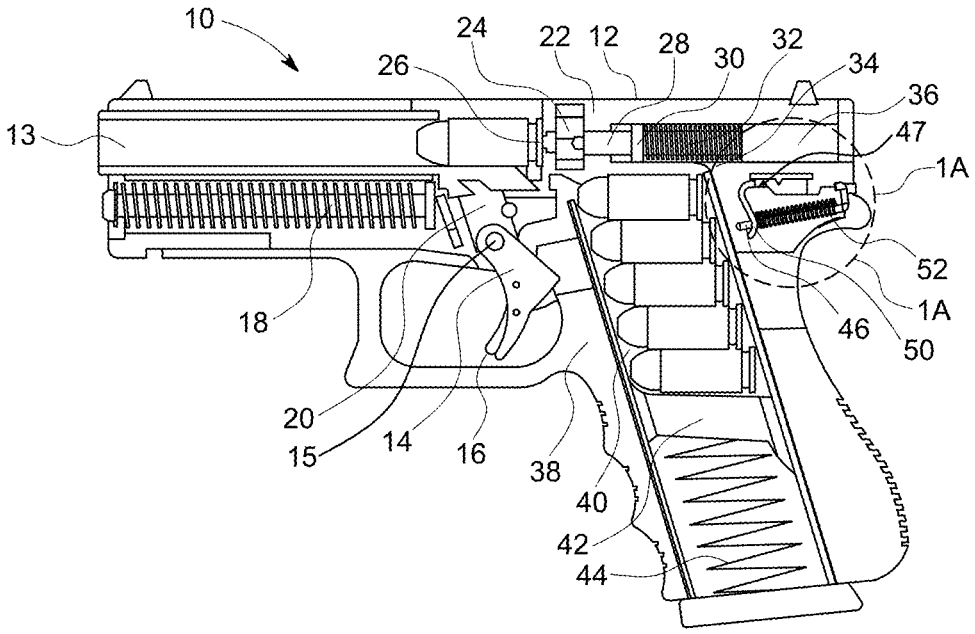
FIG. 1 is a left-side view of a firearm employing an embodiment of a trigger mechanism and includes at FIG. 1A an exploded view of the trigger mechanism.
Figure 1A:
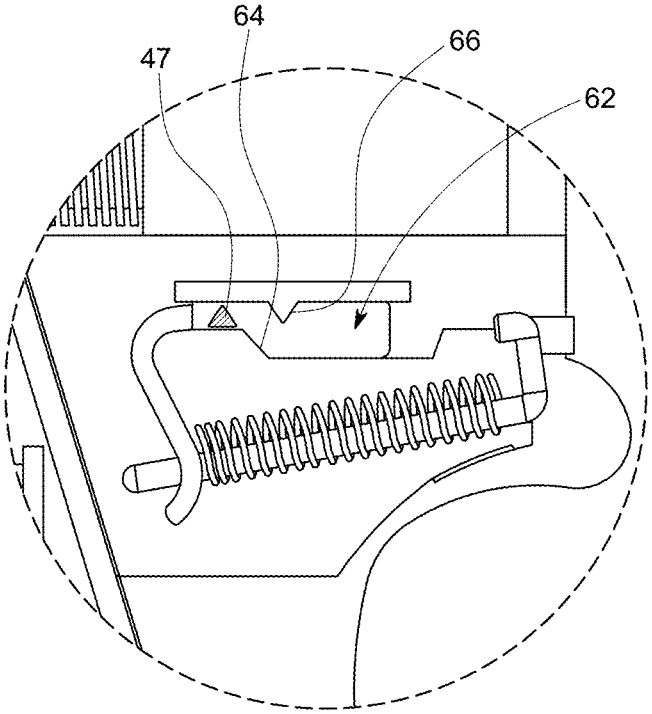
Figure 2:
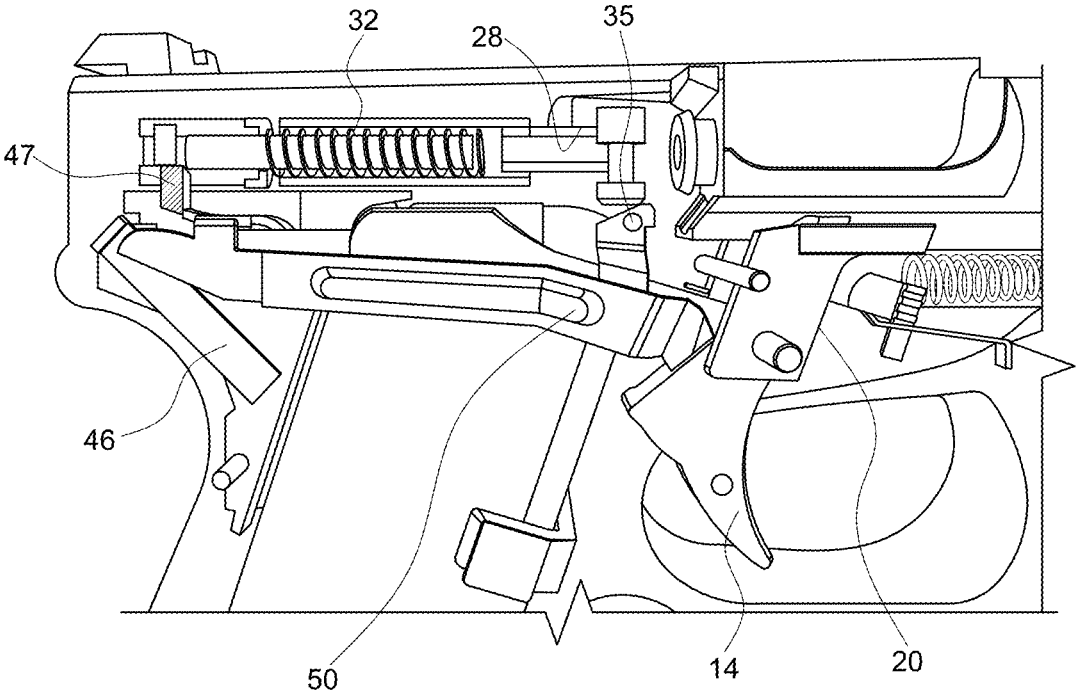
FIG. 2 is a right-side view of the firearm of FIG. 1.

FIG. 1 is a left-side view of a firearm employing an embodiment of a trigger mechanism and includes at FIG. 1A an exploded view of the trigger mechanism as denoted by circular area 1A. Many aspects of the firearm shown as an embodiment in this disclosure take the form of mechanisms and apparatus employed in Glock™ handgun and the trigger mechanism described herein is particularly adapted to be employed in one or more models of a Glock™ handgun. Such a handgun takes the form of a striker fired, short recoil, locked breach, semi-automatic pistol with a polymer frame with a striker assembly housed completely in the slide. In FIG. 1, the handgun 10 includes a frame 12, a barrel 13, a trigger shoe 14 mounted via an opening 15, a trigger safety 16, a recoil rod and spring 18, a locking block 20, a slide 22, a striker safety 24, and an extractor 26. The handgun 10 further includes a striker 28, spring cups 30, striker spring 32, ejector 34 and a spacer sleeve 36. The ejector 34 forcefully ejects the spent cartridge case from the firearm upon extraction by the extractor 26. Turning to FIG. 2, which shows a right-side cutaway view of the firearm of FIG. 1, the striker 28 can be seen. Striker 28 comprises a hardened steel rod approximately two inches in length with a small protrusion on the front forming a firing pin and also includes a lug 35 that extends down from the rear of the striker. The lug 35 contacts and is held in position by the trigger bar guide 47 when the slide 22 is in the racked position.

The handgun 10 further includes a receiver 38, a magazine 40, a follower 42, a magazine spring 44, a connector 46 and a trigger bar guide 47 (which operates as a sear). The foregoing elements of handgun 10 operate in a conventional fashion. The handgun further includes, as shown at FIG. 1A, a trigger bar 50, and a trigger spring 52.

The general operation of the firearm 10 is as follows. The trigger shoe 14 is moveably connected to the trigger bar 50 and as the trigger shoe 14 is pulled, the trigger bar 50 pulls the striker 28 back. The connector 46 guides the trigger bar 50 downward and rearward, releasing the striker 28 and allowing the striker 28 to strike the bullet primer. This causes the bullet to be propelled out of the barrel 13. Recoil that is generated by expanding gases from the powder charge forces the slide 22 back unlocking the barrel 13 as it tilts downward and allows the extractor 26 to remove the spent cartridge from the chamber. The cartridge case is ejected by the ejector when it comes into contact with the cartridge case. As the slide 22 moves forward the bottom rail of the slide 22 strips a new cartridge from the magazine 40 and pushes it up the ramp of the barrel 13 and into the chamber. This completes the cycle and the firearm 10 is ready to fire a next round.

Cartridges are fed into the firearm 10 via magazine spring 44 inside the magazine 40. When the final cartridge has been ejected, the magazine follower 42 forces the locking block 20 up and locks the slide 22 back when the magazine 40 is empty. Trigger safety 16 prevents the trigger shoe 14 from being pulled back unless the trigger safety 16 is engaged.

In conventional operation, the slide 22 moves back, a hook (not shown) on the connector 46 is forced inward. This allows the trigger bar 50 to move upward. As the slide 22 returns forward, the trigger bar 50 is then able to retain the striker 28. Releasing the trigger shoe 14, allows the connector 46 to move back into place, again enabling the downward and rearward movement of the trigger bar 50 when the trigger 50 is pulled. The striker safety 24 blocks movement of the striker 28 such that the striker 28 cannot move past the striker safety 24 unless the trigger bar 50 has pushed it up, allowing the striker 28 to move past the striker safety 24.

The firearm 10 employing the embodiments disclosed herein includes housing 60 mounted within the frame 12. A portion of the housing 60 is shown at FIG. 1A. Trigger bar 50 has a trigger bar guide 47 at an end opposite to the trigger shoe 14. The trigger bar guide 47 is disposed in and held in place within an opening or slot 62 formed within the housing 60. The striker 28 cannot move forward unless the trigger bar 50 has moved back and cleared a ramp 64 of the housing 60. The opening 62 has formed therein a ridge 66 (which may also be referred to as a tooth) positioned on the upper surface of the opening 62.

Figure 3A:
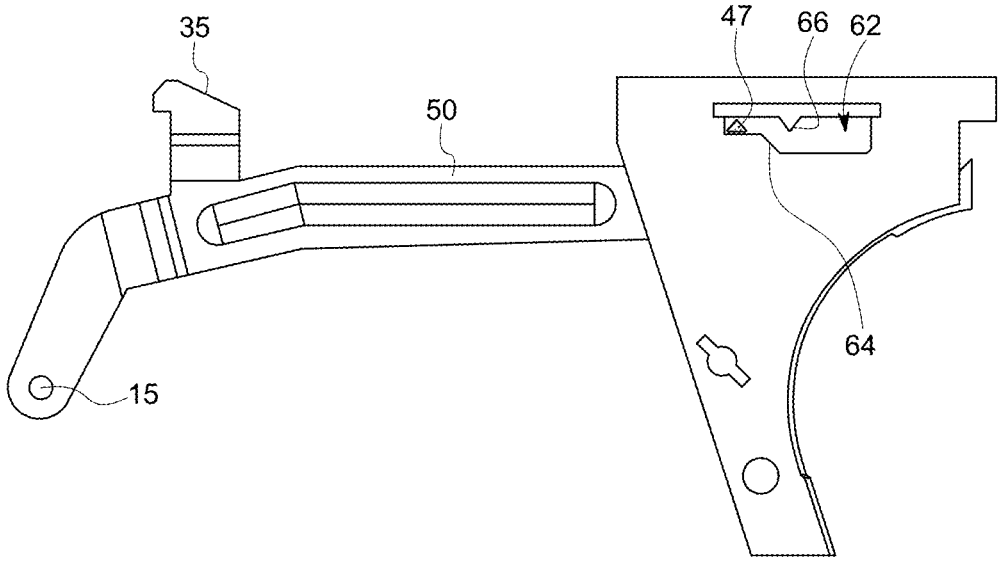
FIG. 3A, FIG. 3B, FIG. 3C and FIG. 3D each show a left-side view of operation of an embodiment of a trigger mechanism.
Figure 3B:
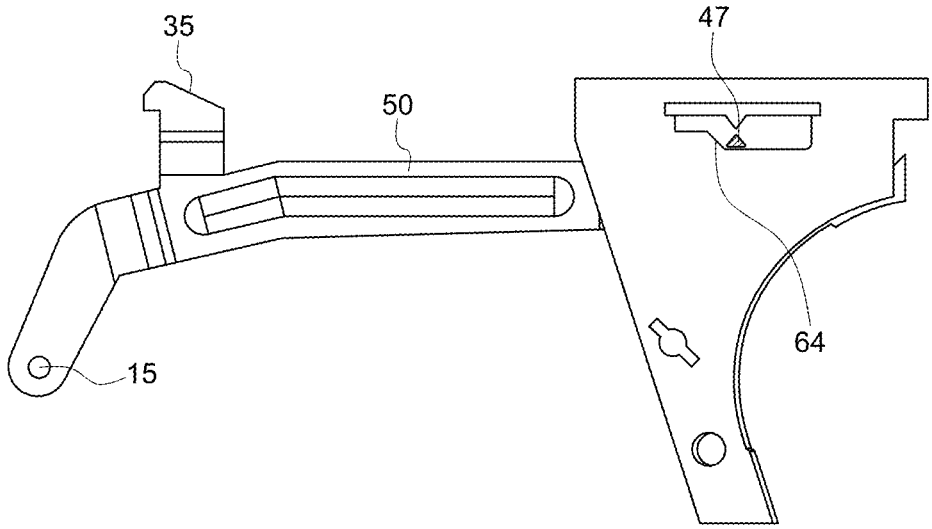
Figure 3C:
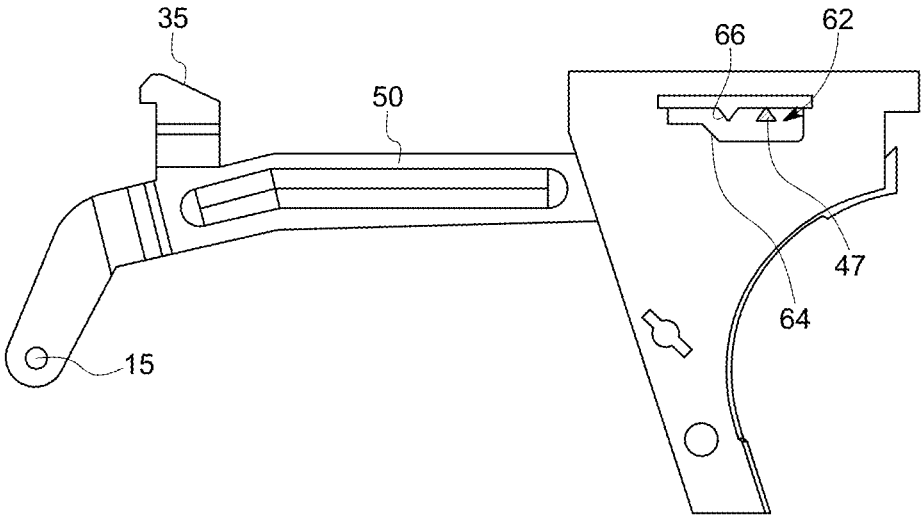
Figure 3D:
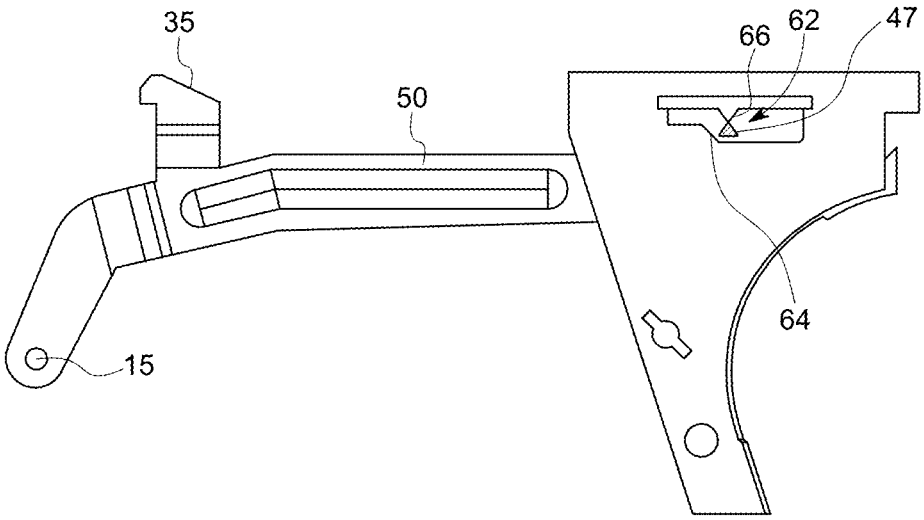

FIGS. 3A, 3B, 3C and 3D each show a left-side view of operation of an embodiment of a trigger mechanism. Movement of the trigger bar 50 in relation to the opening 62 in the housing 60 can be seen in FIGS. 3A, 3B, 3C and 3D which each show a left-side view of the trigger bar 50, housing 60 and movement of the trigger bar guide 47. When the slide 22 has been racked and a round has been loaded into the chamber, the position of the trigger bar guide 47 is shown to be at the front end of the opening 62 (i.e., position 1). In position 1, the striker 28 is under tension and is held in position by the trigger bar guide 47. When the trigger shoe 14 is pulled the trigger bar 50 is pushed horizontally backward (to the right in FIG. 3A). This horizontal backward movement is accompanied by movement in a second dimension (i.e., vertically) caused by the connector 46 which causes the trigger bar guide 47 to be pushed downward until the trigger bar guide 47 is pushed down far enough to release the striker 28 and first firing occurs. In this respect the connector 46 operates as a first disconnector to disconnect the striker 28 from the trigger bar 50 permitting the first firing. At the first firing, the trigger bar guide 47 is in position 2 as shown in FIG. 3B. Position 2 is shown to be at the lower surface of the opening 62. In practice, position 2 includes a position somewhere on the ramp 64 where the trigger bar guide 47 is pushed downward to a point where the striker 28 is released. After first firing, as the slide 22 is pushed back by the recoil of the first fired round, the position of the trigger bar guide 47 is at position 3, as shown in FIG. 3C, where the trigger bar guide 47 is retained at the upper surface of the opening 62, thereby causing the trigger bar guide 47 to retain the striker 28. Upon release of the trigger shoe 14, the trigger bar guide 47 returns to position 1. As the trigger bar guide 47 returns to position 1, ridge 66 operates as a secondary disconnector to push down the trigger bar guide 47, shown as position 4 in FIG. 3D, which causes release of the striker 28, resulting in a second firing. The trigger bar guide returns 47 to position 1 and the two-fire sequence of a first firing on trigger pull and a second firing on trigger release is completed. Position 4 is shown to be at the lower point of the ridge 66. In practice, position 4 includes a position somewhere along the right side the ridge 66 where the trigger bar guide 47 is pushed downward to a point where the striker 28 is released. As can be appreciated from the foregoing, the first function by the user, i.e., trigger pull causes the first firing and the distinct, second function by the user, i.e., trigger release, causes the second firing.

Figure 4:
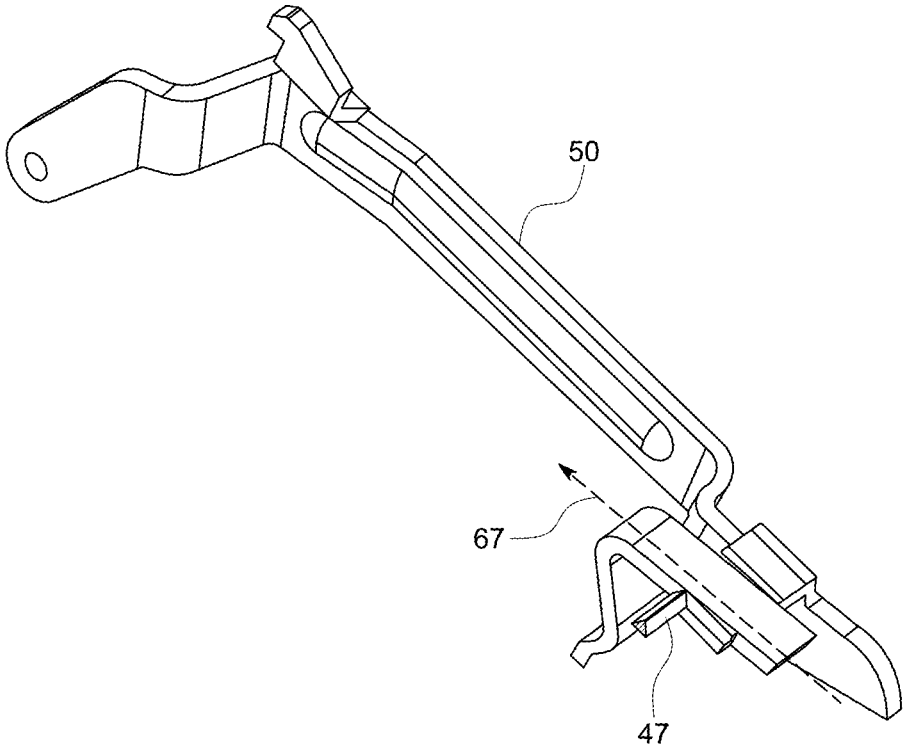
FIG. 4 is an upper angled left-side view of an embodiment of a trigger bar.
Figure 5:
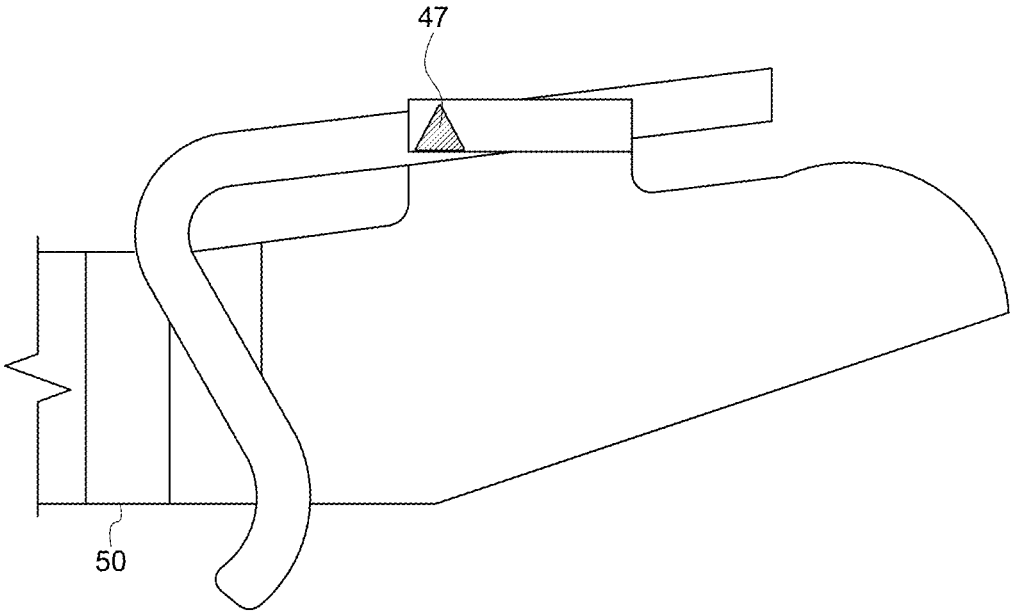
FIG. 5 is a left side view of an embodiment of a trigger bar and trigger bar guide.

The trigger bar 50 is shown in further detail in FIG. 4 which is an upper angled left-side view of an embodiment. The trigger bar 50 is shown to be a variant of a trigger bar found in a conventional Glock™ handgun with the exception of the trigger bar guide 47 which has been modified to shorten (and to reshape) the trigger bar guide 47 along the dimension shown at dotted line 67, which corresponds to the horizontal line of travel of the trigger bar guide 47. This permits the trigger bar guide 47 to be moved around the ridge 66 from position 1 to position 2 to position 3 and from position 3 to position 4 to position 1 where the trigger bar guide 47 is moved along the upper surface of the opening 62, is pushed downward by the ridge 66 and returns upward and forward (to the left in the figures) to position 1. FIG. 5 shows a left-side view of the trigger bar 50 and trigger bar guide 47.

Figure 6:
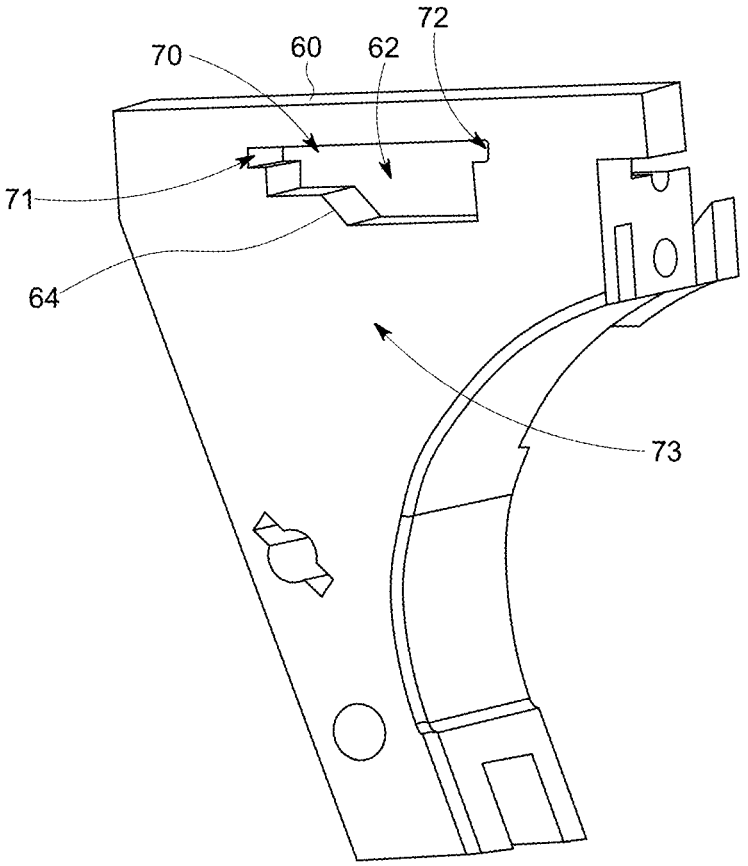
FIG. 6 is an angled left side view of an embodiment of a housing.
Figure 7:
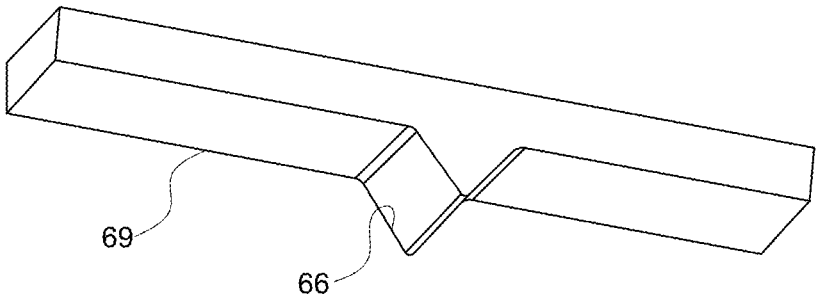
FIG. 7 a an angled upward facing view showing a side and lower portion of an insert for the housing shown in FIG. 6.

FIG. 6 is an angled left side view of an embodiment of housing 60. The housing 60 of FIG. 6 may be formed by modifying a conventional housing of a Glock™ handgun by forming slot 70 into opening 62 where the slot extends partially through the width of the housing 60 and has a length that is longer than the length of the opening 62 sufficient to form supports at the front and rear ends (shown at 71 and 72 respectively) of the opening 62. The slot 70 is sized to accept an insert 69 shown in FIG. 7. The insert 69 has a length, width and thickness to fit into slot 70 such that the insert 69 is flush with exterior surface 73 of the housing 60. The insert 69 has formed thereon ridge 66 which in the embodiment shown extends along the width of the insert. The ridge has a vertical dimension sufficient to push the trigger bar guide 47 to a level sufficient to cause release of the striker 28, in a manner similar to the striker release caused by the connector 46. The ridge 66 in the embodiment shown has linear sides meet at a point to form a triangular shape that extends away from the insert and forms a triangular shaped ridge along the width of the insert 69. While the ridge 66 is shown as having straight lines in the form a V shape, the sides of the ridge 66 need not be straight and may be curved slightly and the point where the side, i.e., the front surface and rear surface of the ridge meet may also be somewhat flattened and rounded such that the exterior surface of the ridge 66 where the front and rear surfaces meet is rounded and may also have a flat portion. In practice, the shape of the ridge 66 will vary according to the precise shape of the trigger bar guide 47 and other factors including the characteristics of trigger spring 52.

Figure 8:
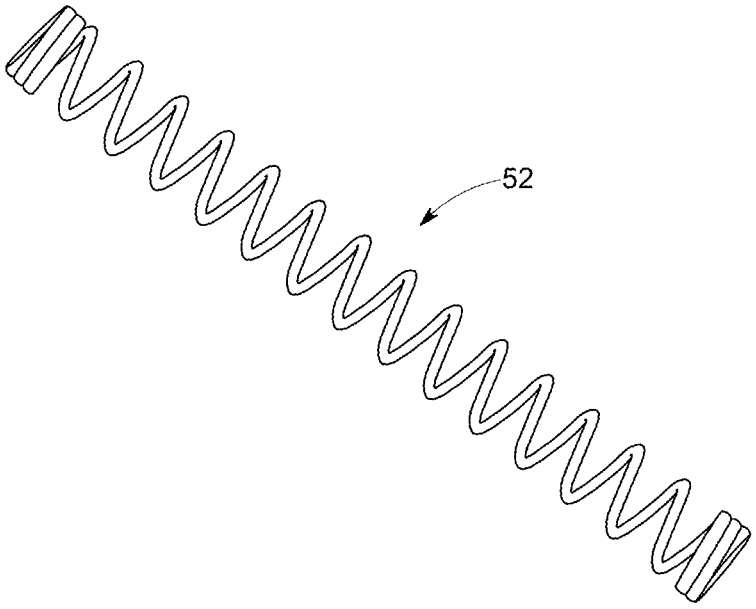
FIG. 8 shows an embodiment of a trigger spring.
Figure 9:
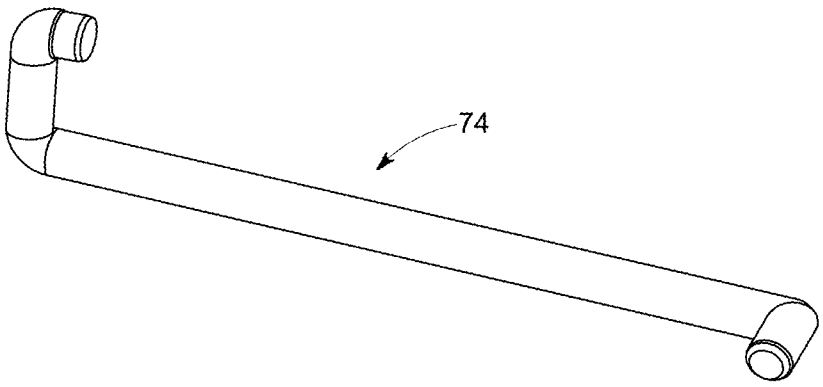
FIG. 9 shows an embodiment of a spring carrier for a trigger spring.

FIG. 8 shows an embodiment of trigger spring 52 which takes the form of a linearly compressing spring that is in an uncompressed state when the trigger shoe 14 is in a released state. Pulling of the trigger shoe 14 to cause release of the striker 28 causes compression of the trigger spring 52 which then expands upon release of the trigger shoe 14 to cause the trigger to return to its released state. Movement of the trigger spring 52 is confined by spring carrier 74 shown in FIG. 9. The tension of trigger spring 52 should be selected to balance the force required for a trigger pull and a return of the trigger shoe 14 to the released state with a force sufficient to cause the trigger bar guide 47 to move from position 3 to position 4 in time to cause release of the striker 28 while the slide 22 is racked.

Figure 10:
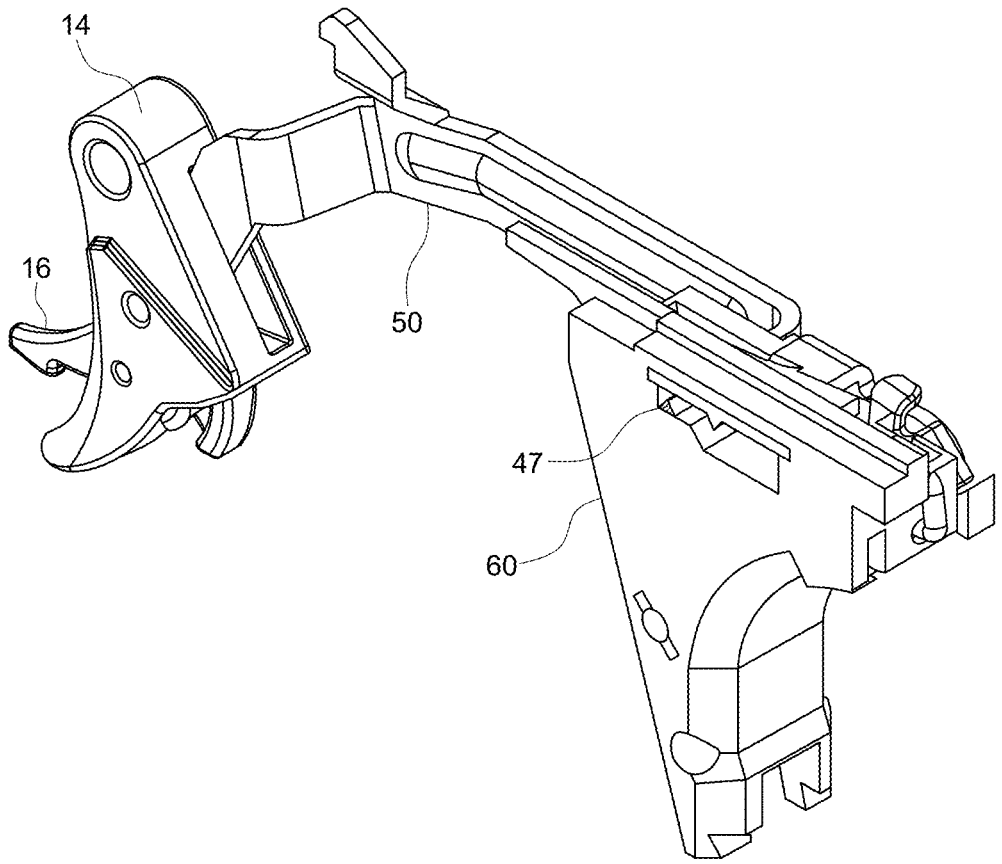
FIG. 10 is an angled upper-left side view of parts of a kit assembled to form portions of the trigger mechanism disclosed herein.
Figure 11:
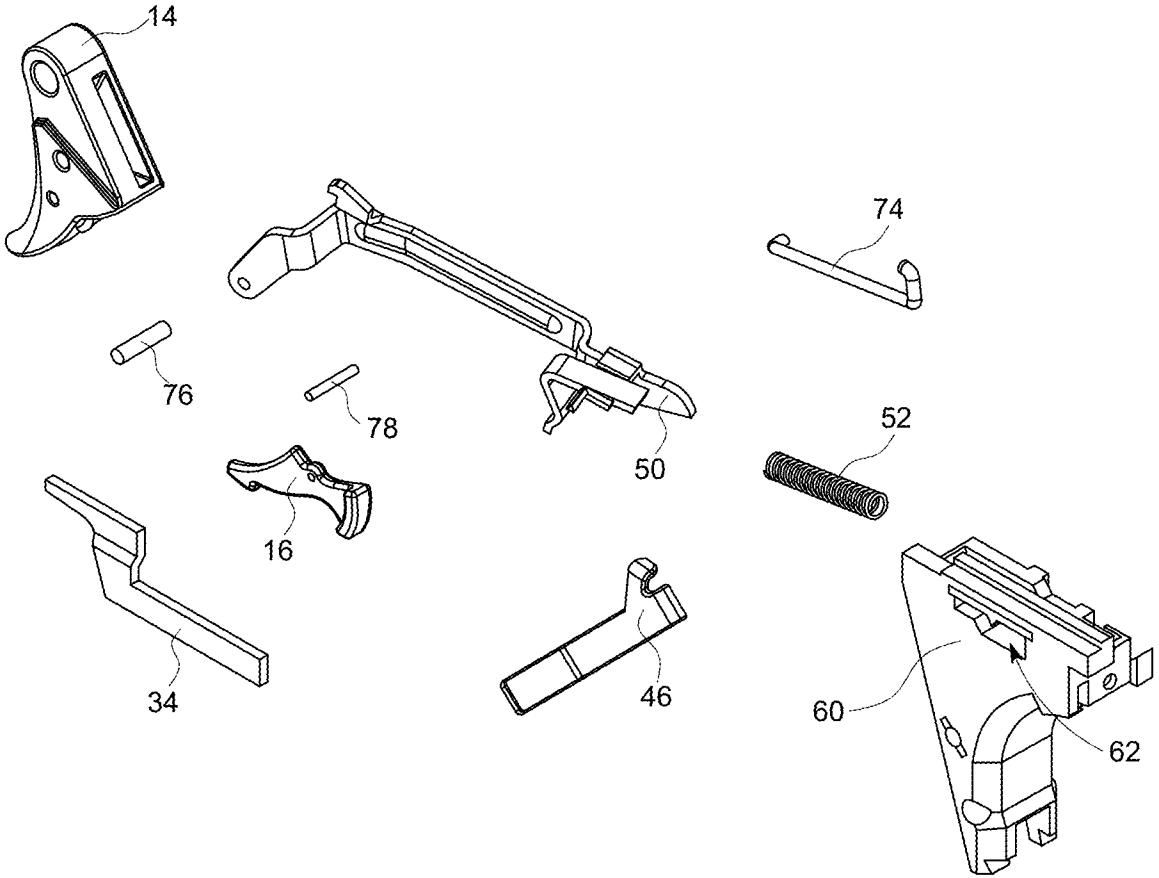
FIG. 11 is an exploded view of the parts of the kit of FIG. 10.

The trigger assembly described herein may also in one embodiment take the form of a kit, the parts of which can be seen in assembled form in FIG. 10 and disassembled form in FIG. 11. One embodiment of the kit includes the following parts, as disclosed herein and configured to be installed in a semi-automatic handgun: a trigger bar 50, a housing 60 with an insert 69 installed therein, a trigger spring 52, a spring carrier 74, ejector 34, connector 46, trigger shoe 14, trigger safety 16, trigger shoe pin 76, and trigger safety pin 78. The trigger shoe pin 76 is mounted into opening 15 and retains the trigger shoe 14 permitting rotation of the trigger shoe about the trigger shoe pin 76. The trigger safety pin 78 retains the trigger safety 16 permitting rotation of the trigger safety 16 about the trigger safety pin 78. The other parts operate as described elsewhere herein.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A firearm comprising:

a frame;

a trigger;

a firing pin;

a connector mounted within the frame;

a housing mounted within the frame and comprising an opening with a sloping ramp;

a trigger bar movably attached to the trigger and movably in contact with the connector, the trigger bar comprising a trigger bar guide positioned within the opening of the housing, the trigger bar guide moving, upon contact of the trigger bar with a surface of the connector, in a first dimension from a first position upon pull of the trigger and moving in a second dimension down the sloping ramp to a second position that causes a first release of the firing pin;

the opening in the housing further comprising a ridge positioned on a surface of the opening that is substantially opposite to the sloping ramp;

wherein the trigger bar upon release of the trigger is caused to return to the first position and during the return to the first position contacts the ridge and is forced downward by the ridge in the second dimension to cause a second release of the firing pin.

2. The firearm of claim 1 wherein the firearm takes the form of a handgun.

3. The firearm of claim 1 wherein the ridge extends away from an upper surface of the opening and is characterized by a cross-section substantially in the form of a triangle.

4. The firearm of claim 1 wherein the ridge extends away from an upper surface of the opening and is characterized by a front surface and a rear surface that meet to form a vertex.

5. The firearm of claim 1 wherein the firearm is a striker fired, short recoil, locked breach, semi-automatic pistol with a polymer frame.

6. The firearm of claim 1 wherein the firearm employs a single linear spring-loaded striker assembly housed completely in a slide.

7. The firearm of claim 1 wherein the striker comprises a hardened steel rod with a small protrusion on the front forming the firing pin, further comprising a lug that extends down from the rear of the striker, the lug contacting and retained by the trigger bar guide when the striker is in a racked position.

8. The firearm of claim 1 further comprising a trigger spring attached to a spring guide, the spring mounted to force the trigger to a released position.

9. A trigger assembly for a firearm comprising:

a housing adapted to be mounted within a frame of the firearm, the housing having formed therein an opening having a first portion having a first vertical dimension and a second portion having a second vertical dimension, the first portion and second portion joined by a ramp to form a lower surface of the opening, the opening having formed thereon a tooth positioned substantially in the second portion and extending downward from the upper surface of the opening;

a trigger bar adapted to be movably attached to a trigger of the firearm and further adapted to be movably in contact with a connector mounted to the frame to cause the trigger bar to be pushed downward upon pull of the trigger, the trigger bar having formed thereon a trigger bar guide adapted to be positioned within the opening of the housing, wherein the trigger bar guide moves upon pull of the trigger from the first portion of the opening along the ramp to the second portion of the opening to cause a first release of a striker of the firearm, the trigger bar guide being pushed upward in the second portion of the opening upon release of the trigger and upon return to the first portion of the opening being pushed downward by the tooth to cause a second release of the striker of the firearm.

10. The trigger assembly of claim 9 further comprising:

a spring carrier; and a trigger spring adapted to be mounted around the spring carrier and further adapted to be mounted to compress upon a pull of the trigger and to force the trigger to a released position.

11. The trigger assembly of claim 10 wherein the tooth is characterized by a cross-section substantially in the form of a triangle.

12. The trigger assembly of claim 10 wherein the tooth is characterized by a front surface and a rear surface that meet at a vertex having a rounded exterior surface.

13. The trigger assembly of claim 12 wherein the front surface and the rear surface are substantially linear.

14. A kit comprising replacement parts for a trigger assembly of a handgun, the kit comprising:

a housing adapted to be mounted within a frame of the handgun, the housing having formed therein an opening having a first portion having a first vertical dimension and a second portion having a second vertical dimension, the first portion and second portion joined by a ramp to form a lower surface of the opening, the opening having formed thereon a tooth positioned substantially in the second portion and extending downward from the upper surface of the opening;

a trigger bar adapted to be movably attached to a trigger of the handgun and further adapted to be movably in contact with a connector mounted to the frame to cause the trigger bar to be pushed downward upon pull of the trigger, the trigger bar having formed thereon a trigger bar guide adapted to be positioned within the opening of the housing, wherein the trigger bar guide moves upon pull of the trigger from the first portion of the opening along the ramp to the second portion of the opening to cause a first release of a striker of the handgun, the trigger bar guide being pushed upward in the second portion of the opening upon release of the trigger and upon return to the first portion of the opening being pushed downward by the tooth to cause a second release of the striker of the handgun;

a spring carrier; and a trigger spring adapted to be mounted around the spring carrier and further adapted to be mounted to compress upon a pull of the trigger and to force the trigger to a released position.

15. The kit of claim 14 further comprising one or more of: an ejector, a connector, a trigger shoe, a trigger safety, a trigger shoe pin, and a trigger safety pin.

16. The kit of claim 15 wherein the parts of the kit are adapted to the handgun which comprises a striker fired, short recoil, locked breach, semi-automatic pistol with a polymer frame.

17. The kit of claim 13 wherein the tooth is characterized by a front surface and a rear surface that meet at a vertex having a rounded exterior surface.

18. The kit of claim 17 wherein the front surface and the rear surface are substantially linear.

* * * * *